US005645257A

United States Patent [19]

Ward

[11] Patent Number: 5,645,257

[45] Date of Patent: Jul. 8, 1997

[54] ADJUSTABLE SUPPORT APPARATUS

[75] Inventor: Michael A. Ward, Wilkes-Barre, Pa.

[73] Assignee: Metro Industries, Inc., Reno, Nev.

[21] Appl. No.: 414,213

[22] Filed: Mar. 31, 1995

[51] Int. Cl.[6] ..... A47G 29/02

[52] U.S. Cl. ..... 248/248; 52/36.4; 108/108; 108/110; 211/187; 211/193; 248/248; 248/250

[58] Field of Search ..... 52/36.4, 36.5; 108/107, 108, 110; 248/235, 243, 244, 245, 248, 250; 211/90, 187, 193

[56] References Cited

U.S. PATENT DOCUMENTS

| | | | |
|---|---|---|---|
| 1,324,246 | 12/1919 | Furman | 248/245 |
| 1,984,473 | 12/1934 | Gibson et al. | 248/243 X |
| 2,340,487 | 2/1944 | Paquette | 248/245 X |
| 2,896,898 | 7/1959 | Penn | 248/245 |
| 3,368,784 | 2/1968 | Peterson | 248/245 |
| 4,103,855 | 8/1978 | Grosse | 211/90 X |
| 4,220,305 | 9/1980 | Pollard | 248/245 |
| 4,223,863 | 9/1980 | Birman | 108/108 X |

*Primary Examiner*—Carl D. Friedman
*Assistant Examiner*—Kevin D. Wilkens
*Attorney, Agent, or Firm*—Fitzpatrick, Cella, Harper & Scinto

[57] ABSTRACT

An adjustable support apparatus includes a vertical standard having a rail, a support member having an edge abutting the standard and a surface formed to fit flush with the rail, and a securing device for securing the support member to the standard. Preferably, the standard includes a channel into which the edge of the support fits. The rail couples to a corresponding bracket on the securing device. The securing device may be mounted on the support member through holes respectively located in the securing device and the support member.

16 Claims, 2 Drawing Sheets

ADJUSTABLE SUPPORT APPARATUS

BACKGROUND OF THE INVENTION

1. Field of the Invention

This invention relates to an adjustable support apparatus, and particularly, to a support apparatus in which an adjustable coupling device shares the load with a rigid support.

Many devices are know for coupling a horizonal platform to a vertical standard. Adjustable shelving devices, brackets, and cantilevered supports readily come to mind. However, many known devices are quite limited in the amount of load they can bear, are expensive to manufacture, or do not provide an entirely satisfactory stable support. One such known device is shown in FIG. 2.

As can be seen in FIG. 2, in this known support apparatus a rigid support 2, having extended tongue portion 12 and horizontal platform 14, is coupled to a vertical standard 4. The vertical standard 4 includes a flat portion 6, a flange 8, and a channel member 10. The channel member 10 includes first and second opposing C-shaped sections designed to embrace the extending tongue portion 12 of rigid support 2.

A bracket 16 is used to the couple rigid support 2 to the vertical standard 4 by gripping the channel member 10 with mating jaws 18 and 20. The bracket 16 is coupled to the rigid support 2 by a bolt 22 which links the lower portions of jaws 18 and 20 together and, when tightened, causes the jaws 18 and 20 to grip the channel member 10.

The known support apparatus of FIG. 2 has certain drawbacks inherent in its design. First, the design may be generally unstable since the bracket 16 can rotate or rock about the channel member 10 in the plane of the drawing, and in a plane perpendicular to the drawing. Second, if excessive force is applied to the rigid support 2, jaws 18 and 20 may be forced apart, become deformed, and loose their grip on channel member 10. Third, in the design depicted in FIG. 2 much of a load on the support 2 must be borne by the jaws 18 and 20, and the bolt 22.

SUMMARY OF THE INVENTION

The present invention provides an adjustable support apparatus that overcomes many of the disadvantages of known support devices, such as that described above.

In its preferred embodiment, the present invention includes a vertical standard, a support member having a horizontal portion and a vertical portion, and an adjustable securing device which couples the vertical standard to the support member. The vertical portion of the support member abuts the vertical standard with two surfaces so that mechanical advantage is produced along the abutment in order to provide greater loadbearing capability and enhanced stability.

The advantageous structure and functions according to the present invention will become apparent from the following detailed description of the preferred embodiment, when taken together in conjunction with the accompanying drawing.

DETAILED DESCRIPTION OF THE PREFERRED EMBODIMENT

Figure 2:
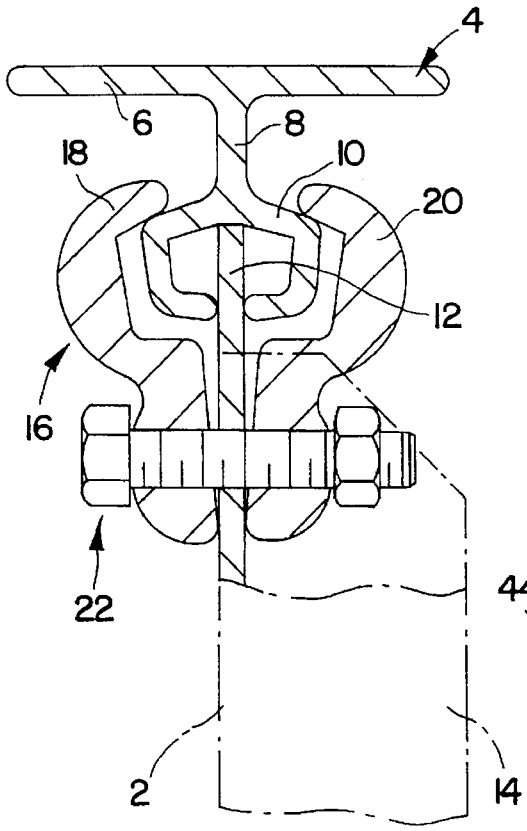
FIG. 2 PRIOR ART
FIG. 2 is a cross-sectional view of a known coupling device.

The present invention is capable of bearing great weight since it makes use of mechanical advantage afforded by the vertical standard itself. In addition, stability is achieved by abutting three perpendicular surfaces of the support with complementary surfaces of the standard. Also, the preferred embodiment is inexpensive to manufacture since it requires fewer surfaces than known adjustable supporting devices, such as that shown in FIG. 2, and uses fewer parts.

Figure 1:
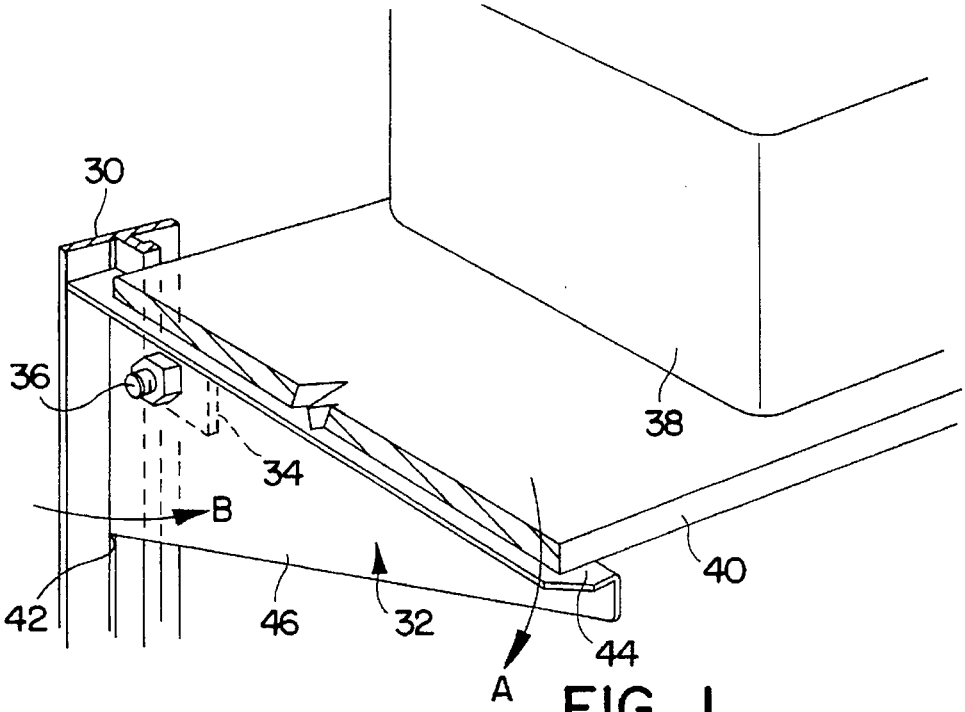
FIG. 1 is a perspective view of the preferred embodiment of the present invention.

FIG. 1 is a perspective view of the preferred embodiment of the present invention, and depicts a vertical standard 30, a support member 32, a connection bracket 34, and a coupling assembly 36, such as a bolt 66 and nut 68.

A weight 38 placed on platform or shelf 40 which rests on the support member 32 will produce a moment A about the coupling assembly 36. In the conventional device depicted in FIG. 2, such moment if excessive will produce great strain on the bracket 16, possibly deforming the jaws 18 and 20 in a way that might cause the structure to fail. However, in the present invention, the moment A is countered by an opposite moment B about the coupling assembly 36. The moment B is produced by abutting surface 42 of support member 32 against vertical standard 30 in a manner described in greater detail below. Thus, the moment B counteracts the moment A and enables the structure according to the present invention to bear great weight.

As shown in FIG. 1, the support member includes a horizontal portion 44 and a vertical portion 46. The horizontal portion 44 supports the platform 40.

Figure 3:
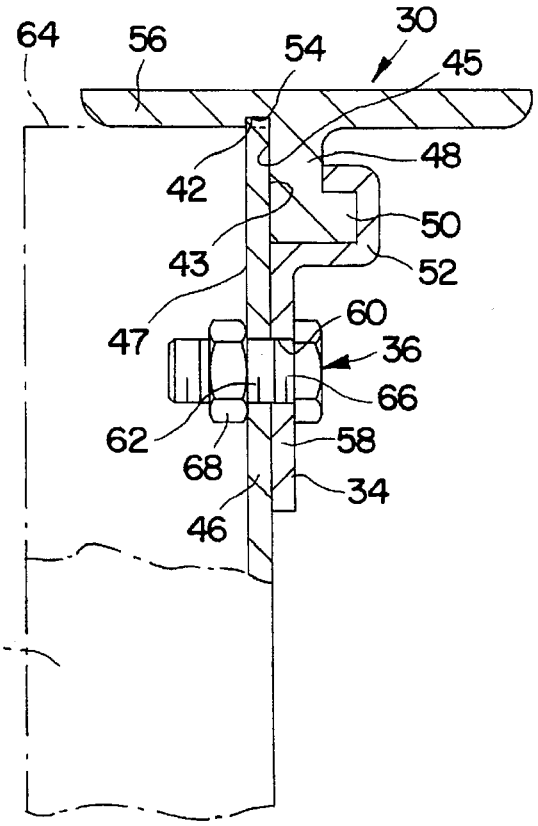
FIG. 3 is a cross-sectional view of the preferred embodiment of the present invention.

FIG. 3 illustrates the structure according to the preferred embodiment in greater detail. As shown there, the vertical standard 30 includes an intermediate portion 48 which terminates in an enlarged rail 50 on one side thereof. The rail 50 is engaged by a corresponding U-shaped knuckle 52 on the connection bracket 34.

The vertical standard 30 also includes a channel 54 having a base 55 and being formed to accept the edge 42 of the vertical portion 46 of the support member 32. The rail 50 and channel 54 of vertical standard 30 extend in the direction of the height of the vertical standard 30 so that the support member 32 may be freely adjusted therealong.

The vertical portion 46 has a surface 43 that is perpendicular to the edge 42 and abuts a complementary surface 45 of intermediate portion 48 of the vertical standard. The vertical portion 46 also has an opposing surface 47 that abuts a side edge 57 of the channel 54 opposite the surface 45. Since the edge 42, surface 47, and surface 43 of the support member 32 fit snugly within the channel 54 and against the surfaces 45 and 57 and base 55 thereof, stability is greatly enhanced.

Vertical standard 30 also includes a section 56 which is adapted to abut the horizontal portion 44 of the support member 32. The section 56 will be described in greater detail with reference to FIG. 5.

FIG. 3 also shows that the connection bracket 34 includes a flat portion 58 having a hole 60 therein. Vertical portion 46 of support member 32 also has a complementary hole 62 that registers with the hole 60 in the connection bracket 34. The flat portion 58 also abuts the surface 43 of the support member 32, further increasing stability.

To assemble the support apparatus according to the present invention, the edge 42 of the vertical portion 46 of the support member 32 is inserted into the channel 54 of the vertical standard 30. At the same time, the edge 64 of horizontal portion 44 of support member 32 is made to but against the section 56 of vertical standard 30. Then, the connection bracket 34 is placed adjacent the vertical portion 46, and the U-shaped knuckle 52 is made to embrace the rail 50 of the vertical standard 30. Holes 60 and 62 are aligned, and the bolt 66 of the coupling assembly 36 is inserted through holes 60 and 62. The nut 68 is then threaded onto to the bolt 66 and tightened in order to securely clamp the connection bracket 36 to both the vertical standard 30 and the support member 32. When a load is placed on support member 32, its weight is supported by the coupling assembly 36, mating rail 50 and knuckle 52, and the interengagement of the edge 42 in the channel 54. In addition, the abutment of edge 64 with the section 56 and the surface 43 with the surface 45 provides stability in the plane of horizontal portion 44 to prevent rocking thereof, and also prevents the support member 32 from being accidentally rotated upwardly or downwardly.

Figure 4:
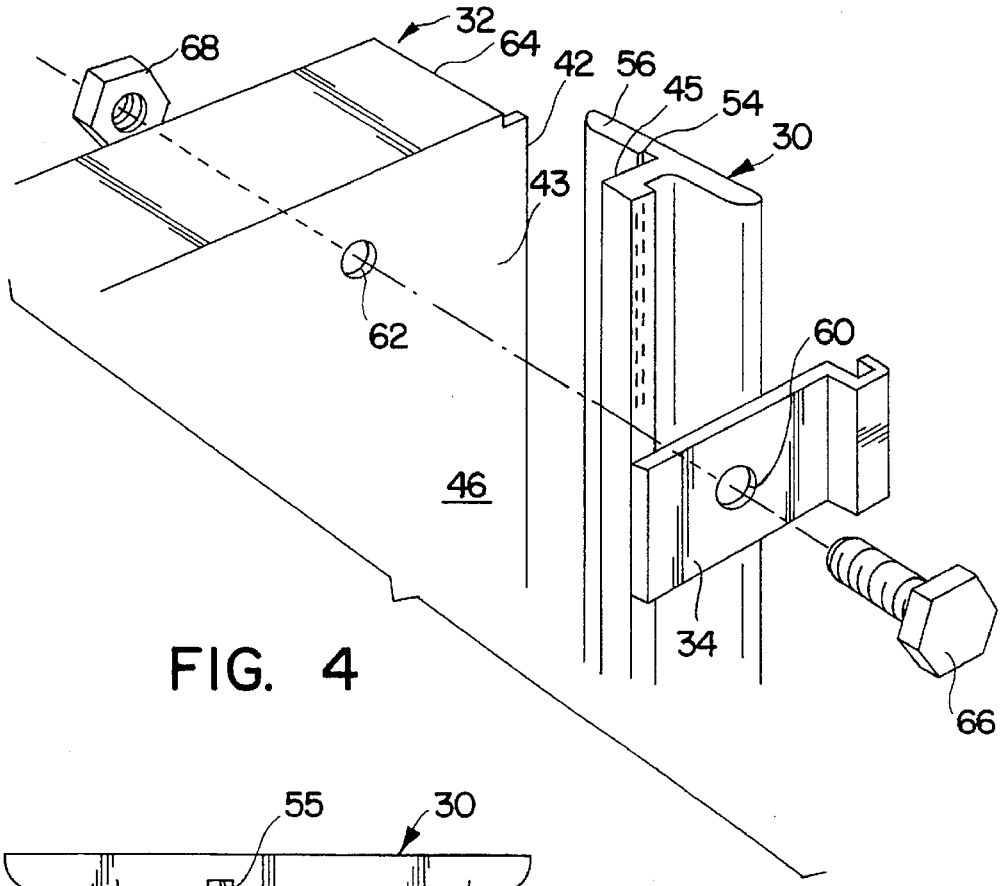
FIG. 4 is a perspective view showing how of the support member and the adjustable securing device of the present invention are attached to the vertical standard.

FIG. 4 is a perspective, exploded view of the apparatus according to the present invention, showing in detail the assembly operation outlined above. In this operation the edge 42 of the vertical portion 46 is inserted into the channel 54. At the same time, the edge 64 of horizontal portion 44 is caused to abut the section 56 of the vertical standard 30, and the surface 43 is placed flush against the surface 45. Note in particular, that the edge 64 is somewhat displaced away from the edge 42, to account for the difference in relative position of the section 56 and base 55 of the channel 54 of the vertical standard 30. Edge 64 should be designed to securely abut the section 56 when the entire length of the edge 42 is securely positioned in the channel 54.

FIG. 4 also shows how the connection bracket 34 is coupled to the vertical portion of the support member 32 by passing the bolt 66 through holes 60 and 62, and threading the nut 68 onto the bolt. At the same time, the U-shaped knuckle 52 of the connection bracket 34 is made to securely engage the rail 50 of the vertical standard 30.

Figure 5:
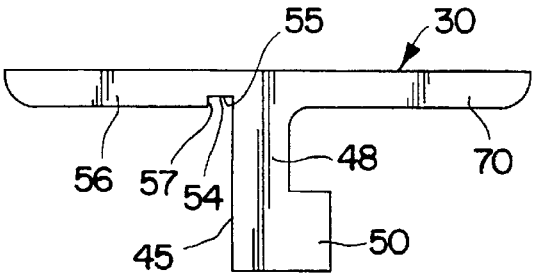
FIG. 5 is a top plan view of the vertical standard of the preferred embodiment of the present invention.

FIG. 5 is a top plan view of the vertical standard 30 clearly showing the relationship between section 56 and channel 54. The section 56 may be thicker or the same thickness as a corresponding opposite section 70 of the vertical standard 30. The particular use to which the apparatus is put, and manufacturing techniques used to make the standard, will influence the relative thicknesses of sections 70 and 56.

The portion 48 and rail 50 of the standard 30 are designed to stably support the load carried by the support member 32. The exact dimensions of these portions will again vary in accordance with the end use and manufacturing practices.

Figure 6:
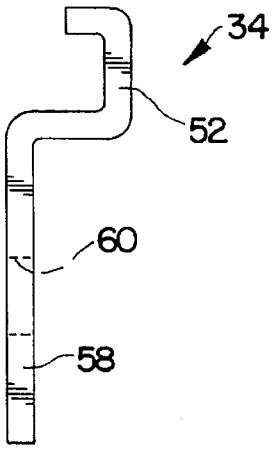
FIG. 6 is a top plan view of the connection bracket according to the preferred embodiment.
Figure 7:
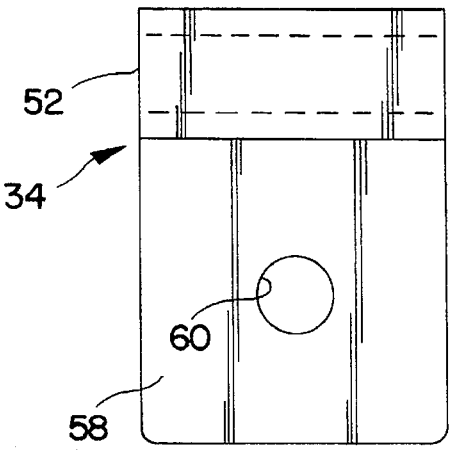
FIG. 7 is a side view of the connection bracket depicted in FIG. 6.

FIGS. 6 and 7 are top and side views, respectively, of the connection bracket 34. The U-shaped knuckle 52 is designed to snugly engage the rail 50 of the vertical standard 30, while the flat portion 58 is designed to stably abut the surface 43 of the vertical portion 46 of the support member 32. The hole 60 is dimensioned to receive the bolt 66 and to register with the hole 62 in the vertical portion 46 of the support member. It should be noted that the hole 62 in the vertical portion 46 is positioned so that it provides maximum mechanical advantage for support member 32, while providing easy access for the insertion and removal of the coupling assembly 36.

The structure depicted in FIGS. 1 and 3 may comprise metal, plastic, a composite, or any other known or convenient materials adaptable for use in supporting a load. The standard 30 may be made as a continuous extrusion. Also, coupling assembly 36 may comprise any other known or convenient means of coupling together the bracket 34 and support member 32, while supporting a load.

Since the rail 50 and channel 54 of the vertical standard 30 extend along the entire height thereof, it should be appreciated that the support member 32 is fully adjustable to an infinite number of positions along the vertical standard 30. This makes the present invention extremely flexible and adaptable to a wide variety of uses.

Furthermore, the vertical standard 30 may be supported in an upright position by being bolted to a wall, bulkhead, or other vertical support. Alternatively, the vertical standard 30 may be supported from a ceiling, or the floor through the use of well-known brackets and supports. In addition, the vertical standard 30 may be mounted in positions other than 90° to the horizontal, depending upon intended use. Still further it can be appreciated that the assembly according to the present invention can be adapted to support forces acting in the horizontal direction. Specifically, the vertical standard 30 may be mounted in a horizontal position and then a horizontally-acting force may be supported. These and other equivalent uses for the present invention are to be included within the scope of the appended claims.

Thus, what has been described is a light-weight, easy to manufacture, easy to assemble apparatus capable of supporting great load in a variety of applications. The present invention will find use in warehouses, stores, homes, or any place requiring a mechanism to support a static load.

While the present invention has been described with respect to what is presently considered to be the preferred embodiment, it is to be understood that the invention is not limited to this disclosed embodiment. To the contrary, the present invention is intended to cover various modifications and equivalent arrangements included within the spirit and scope of the appended claims.

What is claimed is:

1. An adjustable support apparatus, comprising:

a standard having perpendicular side surfaces and formed with a channel therein;

a support having a first surface with a horizontal rear edge and a second surface having a vertical rear edge substantially perpendicular to and extending beyond said horizontal rear edge, said horizontal rear edge of said first surface and said second surface abutting respectively said perpendicular side surfaces of said standard, said first surface adapted to bear a load; and securing means, separate from said support, for securing said support to said standard when said vertical rear edge of said second surface is embraced by said channel.

2. Apparatus according to claim 1, wherein said standard includes a rail and wherein said securing means includes a bracket arranged to embrace said rail.

3. Apparatus according to claim 1, wherein said support causes said vertical rear edge to exert a force on said standard when said first surface bears said load.

4. Apparatus according to claim 1, wherein said standard further comprises:

a base portion for abutting said horizontal first edge of said first surface of said support;

an intermediate portion extending from said base portion and for abutting said second surface of said support; and a rail at an end of said intermediate portion.

5. Apparatus according to claim 4, wherein said securing means comprises a flat portion shaped to butt against said second surface of said support, and a bracket at a distal end of said flat portion and shaped to embrace said rail of said standard.

6. Apparatus according to claim 5, wherein said second surface of said support has a hole and said flat portion of said securing means has a hole registrable with said hole in said second surface of said support.

7. Apparatus according to claim 6, further comprising coupling means for coupling said securing means to said support utilizing said holes.

8. An adjustable support apparatus, comprising:

a standard having a channel therein and a rail extending therefrom;

a support having a first portion adapted to support a load, and a second portion having (a) a protruding rear edge to be embraced by said channel; said protruding rear edge exerting a force on said standard when said first portion of said support supports said load, and (b) a surface abutting said rail; and securing means, separate from said support, for securing said support to said standard, said securing means having (a) a bracket for embracing said rail, and (b) coupling means for coupling said securing means to said second portion of said support.

9. Apparatus according to claim 8, wherein said second portion of said support has a hole, and said securing means further comprises a flat portion fixed to said bracket, said flat portion shaped to fit flush with said surface of said second portion of said support and having a hole registrable with the hole in said second portion of said support, and wherein said coupling means passes through said holes.

10. Apparatus according to claim 8, wherein said first portion of said support has an edge abutting said standard, and wherein said protruding rear edge of said second portion and said edge of said first portion are substantially perpendicular.

11. Apparatus according to claim 8 wherein said standard comprises:

a flat portion;

an intermediate portion extending from said flat portion, said rail extending from a distal end of said intermediate portion on one side thereof; and said channel being formed in said flat portion having a base perpendicular to said intermediate portion.

12. Apparatus according to claim 8, wherein said standard extends a first distance in a first direction; wherein said edge of said second portion of said support extends in said first direction a second distance shorter than said first distance; and wherein said securing means extends in said first direction a third distance shorter than said second distance.

13. Apparatus according to claim 12, wherein said rail of said standard extends said first distance in said first direction to permit said support to be freely adjustable in said first direction, with respect to said standard.

14. A vertical support apparatus, comprising:

a vertical standard having a rail and a channel therein both extending in a vertical direction;

a support member having a horizontal portion with an edge formed to abut said standard, and a vertical portion having an edge to be embraced by said channel; and securing means, separate from said support, having (a) a bracket formed to couple to said rail, and (b) coupling means for fixedly coupling said support member to said securing means.

15. Apparatus according to claim 14, wherein said securing means has a flat portion formed to fit flush with said rail and having a hole therein, and wherein said vertical portion of said support member has a hole therein shaped to register with said securing means hole when said coupling means couples said securing means to said support member.

16. Apparatus according to claim 14, wherein said support member vertical portion edge extends in a first direction farther than said support member horizontal portion edge.

* * * * *